United States Patent [19]

Meyers

[11] Patent Number: 4,764,109

[45] Date of Patent: Aug. 16, 1988

[54] HEAT TREATING, CURING OR STRESS RELIEVING FURNACE

[75] Inventor: Arnold G. Meyers, Waterloo, Canada

[73] Assignee: Clemmer Industries (1964) Limited, Waterloo, Canada

[21] Appl. No.: 64,692

[22] Filed: Jun. 22, 1987

Related U.S. Application Data

[63] Continuation-in-part of Ser. No. 835,724, Mar. 3, 1986, abandoned.

[30] Foreign Application Priority Data

Oct. 16, 1985 [CA] Canada ..... 493083

[51] Int. Cl.[4] ..... F27B 9/08

[52] U.S. Cl. ..... 432/153; 432/167; 432/176; 432/241; 432/192

[58] Field of Search ..... 432/121, 167, 168, 176, 432/192, 133, 137, 153, 241, 237

[56] References Cited

U.S. PATENT DOCUMENTS

| | | | |
|---|---|---|---|
| 1,828,669 | 10/1931 | Kulzinski | 432/167 |
| 1,868,824 | 7/1932 | Gropp | 432/176 |
| 2,084,241 | 6/1937 | Capper | 432/192 |
| 2,182,218 | 12/1939 | Woodson | 432/192 |
| 3,627,290 | 12/1971 | Grieve | 432/176 |
| 3,834,865 | 9/1974 | Lee | 432/241 |
| 3,971,875 | 7/1976 | Regalbuto | 432/241 |
| 4,025,299 | 5/1977 | Dubois | 432/167 |
| 4,050,880 | 9/1977 | Naito et al. | 432/192 |
| 4,494,295 | 1/1985 | Herring | 110/336 |
| 4,591,336 | 5/1986 | Konczalski | 432/153 |

*Primary Examiner*—Henry C. Yuen
*Attorney, Agent, or Firm*—Daryl W. Schnurr

[57] ABSTRACT

An oven for heat treating, curing, stress relieving or otherwise treating objects within the oven has side walls that can be moved into contact and out of contact with side edges of a movable floor. All interior surfaces of the oven are insulated and, when the floor is located in the oven, the side walls can be moved so that the insulation on the side walls forms a sealed relationship with the insulation along the adjacent side edges of the floor. A door of the oven can then be closed. When the door is opened, the side walls can be moved out of contact with the floor and the floor can be removed. Preferably, the side walls are moved by the operation of pneumatic cylinders.

23 Claims, 7 Drawing Sheets

HEAT TREATING, CURING OR STRESS RELIEVING FURNACE

This is a continuation application to application Ser. No. 06/835,724 filed Mar. 3, 1986, now abandoned.

BACKGROUND OF THE INVENTION

1. Field of the Invention

This invention relates to high temperature furnaces and, in particular, to a high temperature furnace or oven of the type having a base or floor that can be moved into or out of the oven.

2. Description of the Prior Art

Relatively large, high temperature furnaces are known and are used in a variety of industries, including, glass, ceramic and metallurgical industries or the like. Ovens or furnaces are often used for curing, heat treating or stress relieving objects placed in the oven and usually have a movable floor, which can be entirely removed from the oven. Usually the floor is mounted on wheels, which in turn are mounted on a track or tracks. When the oven door is open, the floor can be rolled out of the oven or furnace. Objects to be treated or processed in the furnace can then be placed on the floor and the floor can be rolled back into the furnace. The interior surfaces of the furnace or oven, including the floor are insulated to protect external areas of the furnace from the intense heat and also to conserve energy. It is important in the operation of such a furnace or oven that the joints between the floor and the rest of the oven, including the door, be sealed with insulation.

In some furnaces, this sealing relationship is accomplished by manually inserting insulation into the joint between the floor and the interior of the surface after the floor has been placed in the furnace and, subsequently manually removing the insulation when it is desired to remove the floor from the furnace. In another type of furnace, the floor is sealed by a sand trough. In another type of furnace, lower edges of side walls of the furnace are tapered to correspond with tapered upper edges of side walls on the floor. However, either the prior art furnaces do not achieve a satisfactory sealing arrangement, or the movement of the floor relative to the side walls causes abrasive wear or flattening of the insulation material, thereby greatly reducing its effective life or, because of the tight sealing relationship that is required, the furnace must be manufactured with a high degree of tolerance between different parts and is therefore too expensive, or, the sealing procedure is too time consuming or too complex.

SUMMARY OF THE INVENTION

It is an object of the present invention to provide a high temperature oven having a removable floor whereby the side walls are moved out of contact with said floor prior to moving said floor relative to said walls, thereby eliminating abrasion of the insulating material between said floor and said side walls and extending the life of said material.

An oven for curing, heat treating, stress relieving or otherwise treating or processing objects is mounted on a supporting surface and has two side walls, two end walls, a floor and a top, each being insulated. One of said end walls is a door that can be opened and closed. There are means for affixing said side walls to said top. The side walls are movable laterally relative to said floor. There are actuators to move a lower portion of said side walls laterally into and out of a sealing relationship with said floor. The floor has support means so that the floor is readily removable from and replaceable in said oven. The actuators remain stationary as said floor is removed, with said side walls being totally disengaged from said floor. A lower portion of said side walls is movable so that, when said floor is placed in said oven, the lower portion of said side walls can be moved and held in tight contact with adjacent side edges of said floor and the door can be closed so that an interior of said oven is insulated from an exterior. When the floor is desired to be removed from the oven, the door can be opened and the lower portion of said side walls can be moved out of contact with the adjacent side edges of said floor and said floor can then be removed from said oven. There are means to move a lower portion of said side walls relative to said floor and the oven has a heat source with means to circulate heat within said oven.

A method of curing, heat treating, stress relieving or otherwise processing objects uses an oven having two side walls, two end walls, a floor and a top, each being insulated. One of the end walls is a door that can be opened and closed. The floor is readily removable and replaceable in said oven, a lower portion of said side walls is movable relative to said floor so that insulation on a lower portion of said side walls can be moved into and out of a sealing relationship with adjacent side edges of insulation on said floor. There are means to move a lower portion of said side walls relative to said floor, the oven having a heat source with means to circulate said heat within said oven. The method commences when a floor is located outside of said oven, the door is opened and the lower portion of said side walls is moved out of contact with said floor. The method is placing the objects to be treated on said floor, moving said floor into said oven until an inner end of said floor contacts an interior of an end wall of said oven, moving the side walls so that the layer of insulation on a lower portion of said side walls is in a sealed relationship with the insulation on the adjacent side edges of said floor, closing the door to said oven so that the insulation of said door is in a sealed relationship with the insulation on the top, side walls and floor, activating the heat source and the means for circulating the heat within the oven, after the objects have been heated as desired, turning off the heat source, opening the door, moving the lower portion of the side walls out of contact with the adjacent side edges of the floor and removing the floor from said furnace.

BRIEF DESCRIPTION OF THE DRAWINGS

In drawings which illustrate a preferred embodiment of the invention.

DESCRIPTION OF A PREFERRED EMBODIMENT

Figure 1:
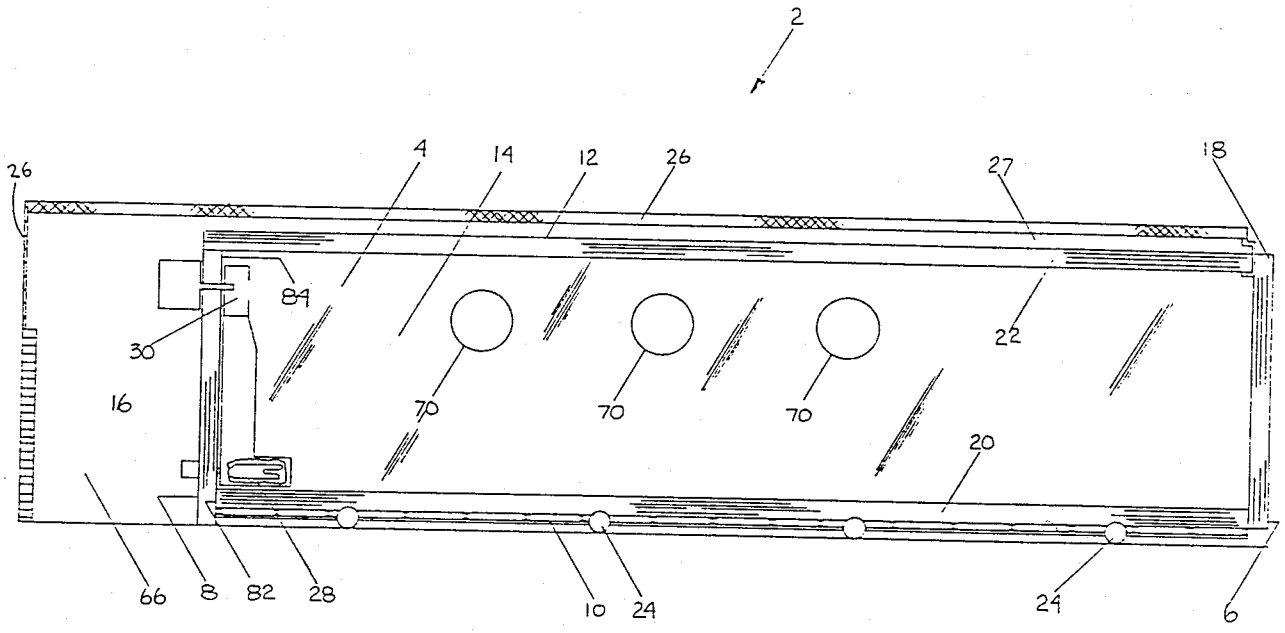
FIG. 1 is a side view of an oven with a side wall of the oven and a casing removed to expose an interior.

Referring to the drawings in greater detail, in FIG. 1, an oven 2 has two side walls 4 (only one of which is shown in FIG. 1), two end walls 6, 8, a floor 10 and a top 12. Each of the two side walls 4, end walls 6, 8, floor 10 and top 12 are insulated on an interior surface thereof with a layer of insulation 14, 16, 18, 20, 22 respectively. The end wall 6 is actually a door 6 that can be opened and closed. The floor 20 is readily removable from and replaceable in said oven 2 and is mounted on wheels 24, said wheels being located beneath said layer of insulation 20.

An insulated casing 26 surrounds said oven 2, except in the area of said door 6 and is separated from the oven 2 by an air space 27. For illustrative purposes, one side of the casing 26 has been removed from FIG. 1 to expose an interior of the oven. The oven 2 contains a heat source 28 used to circulate heat within said oven 2. The heat source 28 is an electrical element and the means to circulate the heat within the oven is a fan or blower 30. The blower 30 has been partially cut away to expose the heat source 28. Other types of heat sources could be used within the oven and will be readily apparent to those skilled in the art. For example, many ovens have a gas burner. Also, the heat could be circulated in many different ways.

The casing 26 extends beyond the end wall 8 and houses an electrical control box (not shown) for the oven 2. The control box controls the heat source 28 and the blower 30 that are mounted just inside an end 8 of the oven 2. The purpose of the casing 26 is to assist in retaining the heat generated by the oven 2. In some uses, the main purpose of the casing will be to conserve energy. In other uses, the main purpose of the casing will be to allow persons near the oven to work in comfort. In still other uses, the casing will not be used at all.

Figure 2:
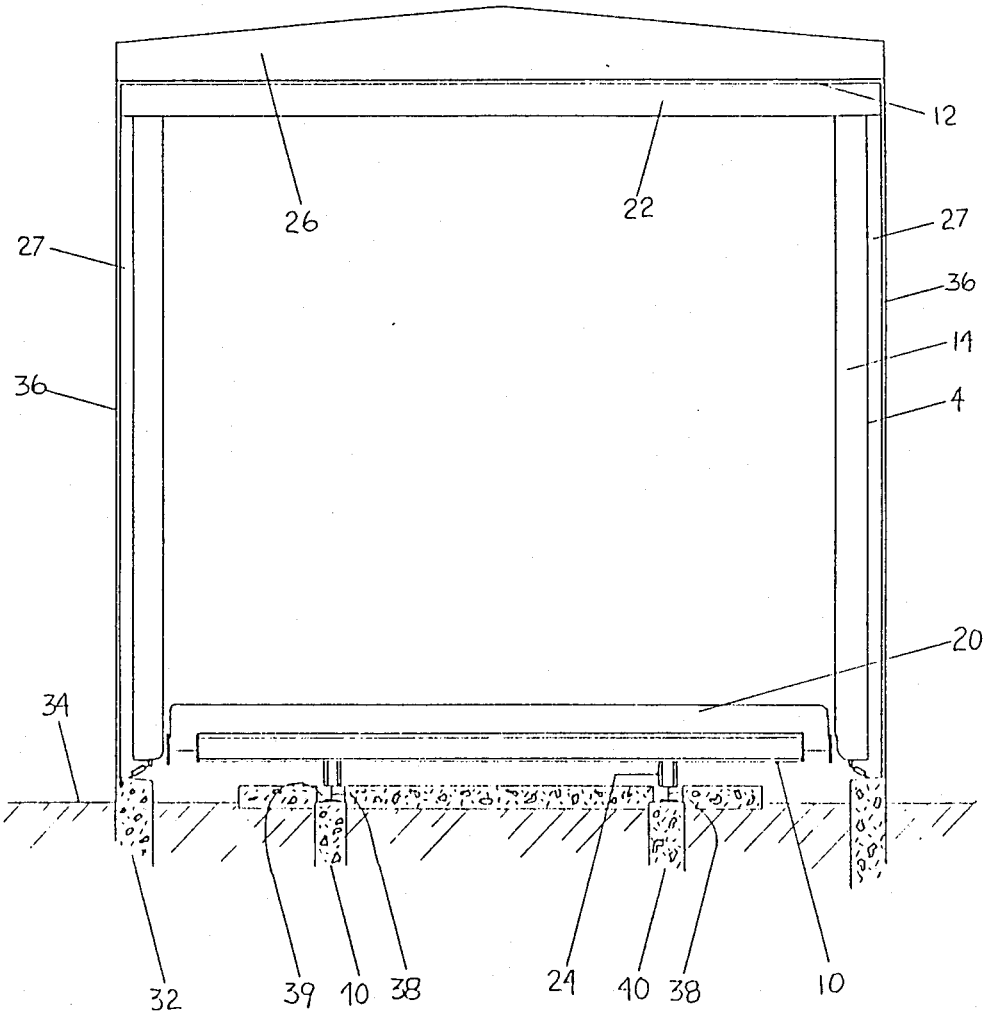
FIG. 2 is an end view of an oven with a door removed showing hydraulic cylinders located on either side of said oven.

From FIG. 2, it oan be seen that the outer casing 26 is mounted on concrete supports 32. The concrete supports 32 are embedded in a supporting surface 34. Also, it can readily be seen that the top 12 extends laterally beyond the side walls 4 and is affixed to side walls 36 of the casing 26. The side walls 4 each have a lower edge that is suspended above said supporting surface 34. The floor 10 has guide means 38 for wheels 24, said guide means being tracks that extend into said oven 2. The tracks 38 are supported by concrete supports 40 embedded in supporting surface 34. If desired, the tracks 38 could be omitted and the wheels 24 could be guided by channel 39.

Figure 3:
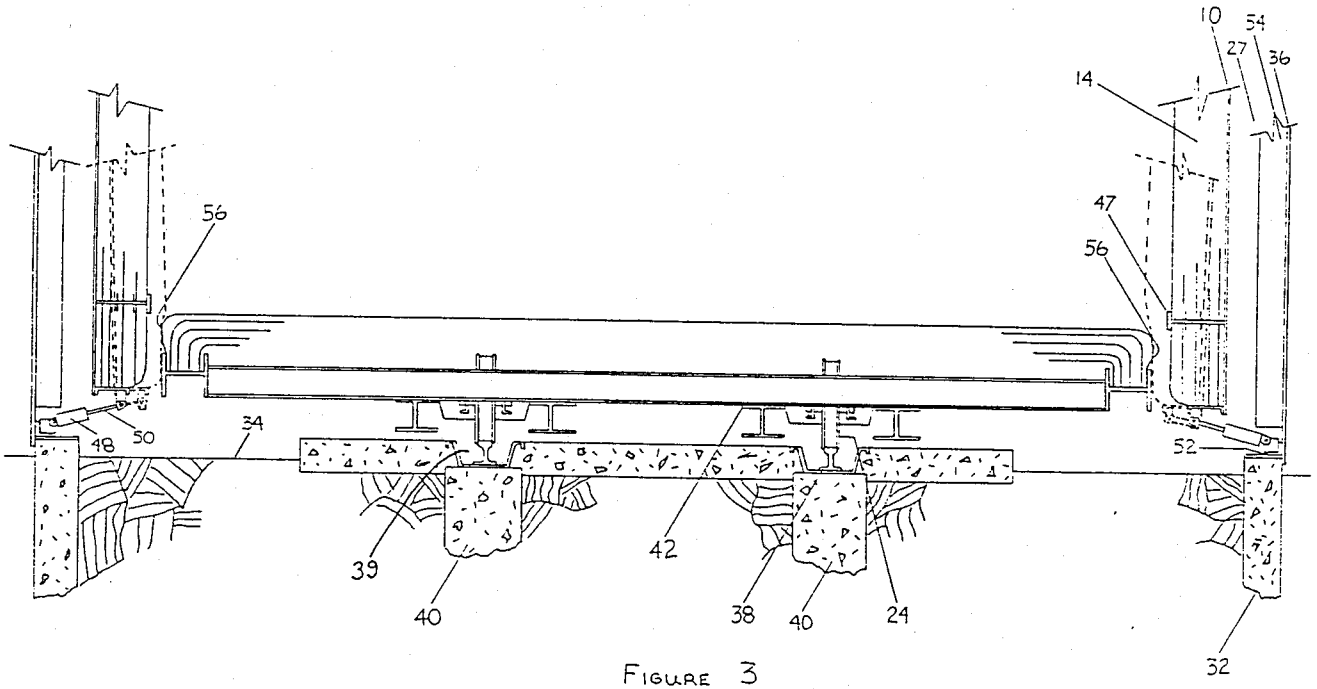
FIG. 3 is an expanded partial end view with the door removed showing opened and closed positions of said side walls.

From FIG. 3, it can be seen that the floor has a frame 42, which supports axles 44 for wheels 24. The frame 42 is a typical frame for a movable floor or car of a furnace. Variations in said frame will be readily apparent to those skilled in the art. Along each longitudinal side 46 of the floor 10, there is located a steel I-beam in which ends of the insulation 20 are held. Each side 46 is adjacent to the side walls 4 when the floor 10 is located within the oven 2. The insulation 14, 16, 18, 20, 22 is mounted using mounting spikes 47.

Pneumatic cylinders 48 are mounted between a lower edge 50 of said side walls 4 and a base 52 of said side walls 36 of said casing 26. For the purposes of this specification, "pneumatic cylinders" and "cylinders" shall be interpreted to include, all fluid cylinders, and, specifically, to include hydraulic cylinders. A series of pneumatic cylinders 48 (only one of which is shown for each side wall in FIG. 3) are mounted along each side wall. The number of cylinders 48 is not particularly significant, so long as there are sufficient cylinders to move each wall 4 efficiently. The number of cylinders 48 will obviously vary with the length of the oven. It can be seen that the side walls 36 of the casing 26 have a layer 54 of insulation along an interior surface thereof. The pneumatic cylinders preferably have a single control so that they can be activated simultaneously.

The position of a lower portion of the side walls 4 and pneumatic cylinders 48 shown in the solid lines in FIG. 3 is the "open" position where the side walls have been moved out of contact with longitudinal side edges 56 of the floor 10. The position of the lower portion of the side walls 4 and pneumatic cylinders 48 shown in the dotted lines in FIG. 3 is the "closed" position where the side walls have been moved and can be held in tight contact with the longitudinal side edges of the floor 10. When the floor is placed in said oven, the side walls can be moved to the "closed" position and the door 6 can be closed so that an interior of said oven 2 is insulated from an exterior. When said floor 10 is desired to be removed from said oven 2, the door 6 can be opened and the side walls 4 can be moved to the open position. The floor 10 can then be removed from said oven 2. The pneumatic cylinders 48 are actuators to rapidly move a lower portion of said side walls 4 laterally into and out of a sealing relationship with said floor 10. The pneumatic cylinders can be referred to as actuators to move the side walls 4. Other types of actuators, for example, mechanical actuators, will be readily apparent to those skilled in the art and are included within the scope of the attached claims. The air connections for the pneumatic cylinders have been omitted from the drawings as these are considered to be conventional. The pneumatic cylinders 48 are mounted on the side walls 4 exterior of said insulation in order to move said side walls relative to said floor 10. The side walls 4 provide a hard shell and the layer of insulation 14 is mounted on an interior surface of said hard shell (best shown in FIGS. 2 and 3). The hard shell 4 is sufficiently bendable and resilient that a lower portion of said side walls can be moved relative to said floor 10 so that the layer of insulation 14 on said side walls 4 can be removed repeatedly into and out of contact with the insulation on said floor. As best shown in FIG. 2, the side walls 4 have an upper portion that is rigidly affixed to said top 12.

Figure 4:
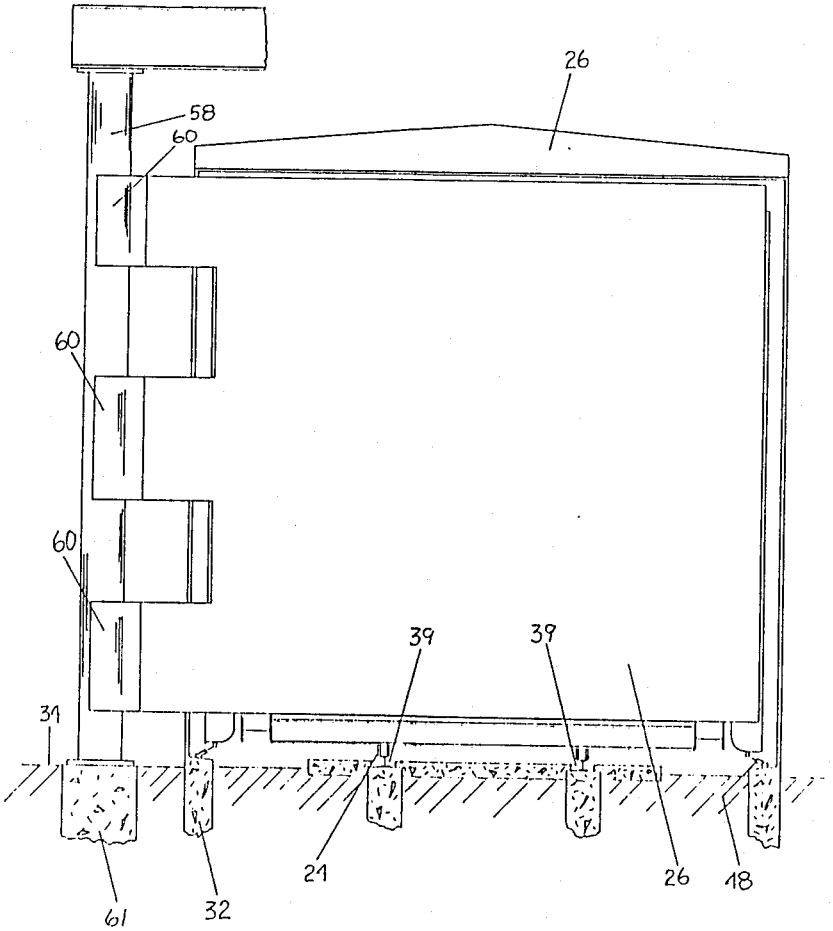
FIG. 4 is an end view of the oven with the door closed.
Figure 5:
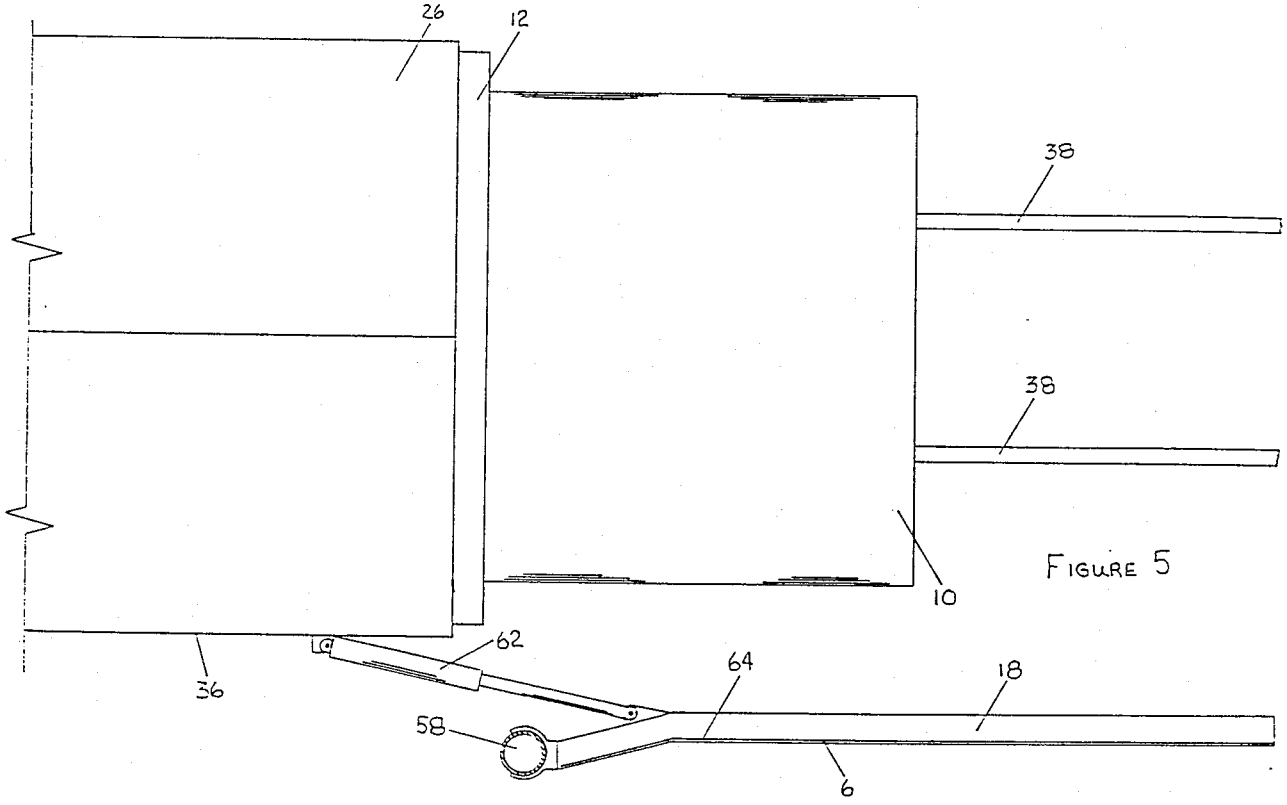
FIG. 5 is a partial top view with the door open and a floor partially removed.

In FIG. 4, there is shown an end view of the oven or furnace 2 with the door 6 in a closed position. The door 6 is pivotally mounted about a post 58 by hinges 60. The post 58 is located away and is embedded in concrete 61 in the supporting surface 34. The door 6 is pivotally mounted about a point located away from the oven 2 so that the door can swing into tight contact with the side walls 4, floor 10 and top 12 when the door is in a closed position and can swing out of contact with said walls, floor and top when the door is in an open position. As shown in FIG. 5, it is important that the door 6 be able to swing open at approximately 90° so that the floor 10 can be removed from the oven 2 without striking the door 6. The door 6 is opened and closed by pneumatic cylinders 62 (only one of which is shown) mounted between the side wall 36 of the casing 26 and an interior surface 64 of the door 6. A sufficient number of pneumatic cylinders 62 are utilized so that the door can be closed with the insulation 18 in a sealed relationship with the insulation on the side walls 4, floor 10 and top 12 of the oven 2. As with the side walls 4, pneumatic cylinders 62 are deemed to include all fluid cylinders, including hydraulic cylinders. The air connections for the cylinders 62 have been omitted as they are conventional.

Figure 6:
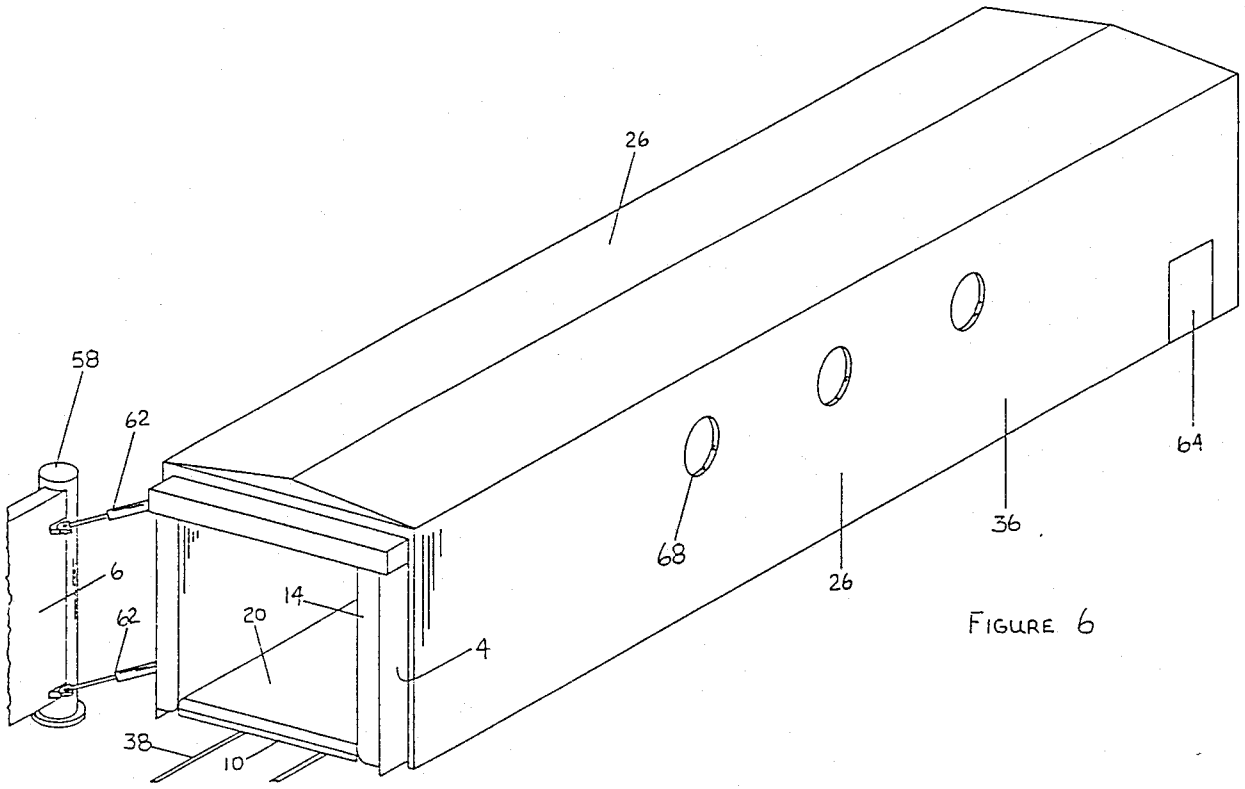
FIG. 6 is a partial perspective view showing the oven, with the door open, extending partially out of an insulated casing.

In FIG. 6, there is shown the casing 26 with a front part of the oven 2 extending out of the casing. The floor 10 is located within the oven 2 and the door 6 is only partially shown, said door being in an open position. A cover 64 at the rear of the casing 26 can be removed to allow access to a compartment 66 shown in FIG. 1.

Observation windows 68 are located in the wall 36 of the casing 26. Observation windows 70 are located in the side wall 4 and are aligned with the windows 68. The observation windows are optional and, when it is desired to use them, they should be properly insulated. While the observation windows 68, 70 are shown in the side walls of the casing and oven, preferably, if observation windows are used, they would be located in the end 8 of the oven 2. When used in that location, it is not necessary to have any windows in the casing and access can be gained to the compartment 66 through the cover or door 64.

The side walls 4 have thus far been described as having a hard shell with a layer of insulation 14 mounted on an interior surface thereof. The hard shell 4 is bendable and resilient enough so that a lower portion of the side walls can be moved into and out of contact with the floor 10 simply by forcing the side walls to bend slightly. There are numerous materials that will be suitable for making the hard shell of the side walls 4. One material that can be used is galvanized steel and it is suggested that a thickness of 0.116 inches will be suitable. Other material and/or other thicknesses for the hard shell will be readily apparent to those skilled in the art.

Figure 7:
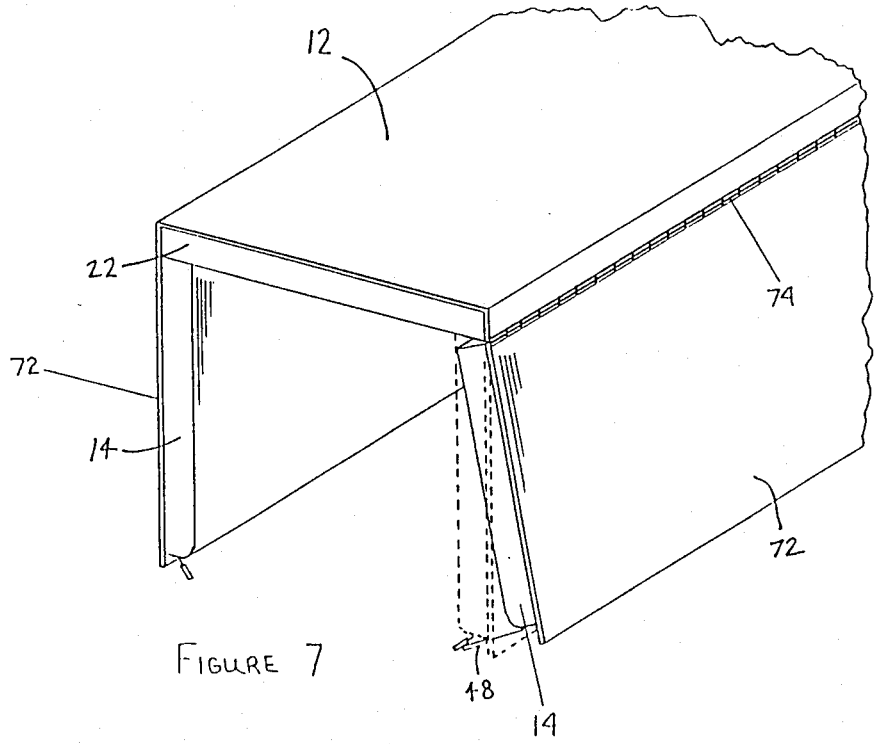
FIG. 7 is a partial perspective view of a variation in the oven showing a side wall hinged to a top of the oven.

In a variation of the side walls, shown in FIG. 7, a side wall 72 is hinged along a line of contact 74 with the top 12. The side wall 72 is shown in an open position by the solid lines and in a closed position by the dotted lines. The other side wall 72 is shown in a closed position. As the pneumatic cylinders and other components of the oven are the same as those previously described, these items have been omitted from FIG. 7. Likewise, the casing 26 has been omitted from FIG. 7.

Figure 8:
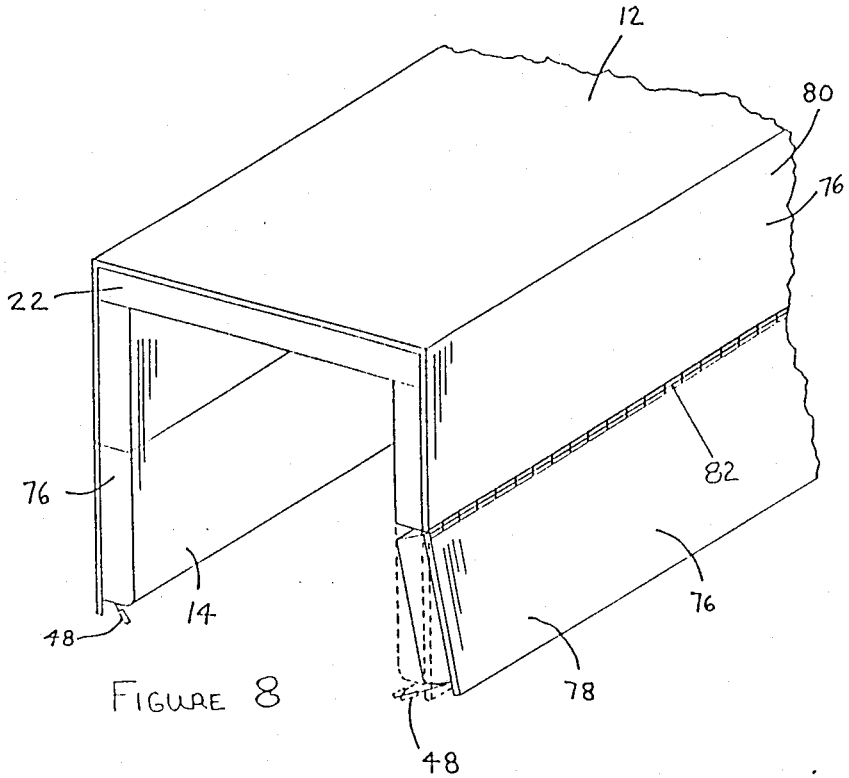
FIG. 8 is a partial perspective view of another variation in the oven showing the lower portion of a side wall hinged to an upper portion of the side wall.

In a further variation of the side walls, in FIG. 8, a side wall 76 has a lower portion 78 and an upper portion 80. The upper portion 80 is rigidly affixed to a top 12 and the lower portion 78 is pivotally mounted on said upper portion 80 by being hinged to said upper portion by hinges 82. The side wall 76 is shown in the open position by the solid lines of FIG. 8 and in a closed position by the dotted lines of FIG. 8. The remaining side wall 76 is shown in a closed position. As with FIG. 7, the remaining components, including the casing 26, that make up the oven 2 have already been previously described in FIGS. 1 to 6 and have been omitted from FIG. 8.

The variations described in the side walls shown in FIGS. 7 and 8 are not considered to be as desirable as the bendable side wall 4 shown in FIGS. 1 to 6. The bendable side wall 4 is the preferred side wall of this invention.

The floor 10 can have a frame of any suitable material but a suggested material for the frame is galvanized steel. Also, a suggested insulation is fibre wool.

The oven can be designed to operate in a broad temperature range and a suggested maximum temperature ranges from 1200° F. to 3000° F. However, in some applications a maximum temperature much lower than 1200° F., (for example, 150° F.) will be sufficient. When observation windows are used, they must be made of a material that will withstand the intense heat, for example, Pyrex, a trade mark. Preferably, the observation windows will each contain two panes of glass. Ovens, in accordance with the present invention, can be made in various sizes. While the invention is not limited to a specific size, a typical size oven can have an overall length of seventy feet with the casing, etc. A typical size has an overall length of seventy feet with the casing having an overall length of eighty feet. The width and height of said oven is approximately twenty feet giving an oven volume of approximately 18,500 cubic feet. The blower is designed to circulate over once every one and a half minutes throughout the oven. Six forty-eight kilowatt electric heaters are suggested for heating the oven to a maximum temperature of approximately 1200° F.

In operation, the oven 2 oan be used as follows:

(a) commencing when the floor is located outside of the oven, the door is opened and the lower portion of said side walls is moved to the open position;

(b) placing objects (not shown) to be treated on said floor 10;

(c) moving said floor 10 into said oven 2 until an inner end 82 (see FIG. 1) of said floor 10 contacts an interior 84 of an end wall 8 of said oven 2;

(d) moving the side walls 4 so that insulation 14 on a lower portion of said side walls is in a sealed relationship with insulation on the longitudinal side edges 54 of said floor 10;

(e) closing the door 6 so that insulation 18 on said door 6 is in a sealed relationship with insulation 22, 14 and 20 on the top 12, side walls 4 and floor 10 respectively;

(f) activating the heat source 28 and the means for circulating the heat 30 within the oven 2;

(g) after the objects have been treated as desired, turning off the heat source;

(h) opening the door 6;

(i) moving the lower portion of the side walls 4 out of contact with the longitudinal side edges 54 of the floor 10; and (j) removing the floor 10 from said oven 2 and removing the objects treated.

One advantage of the oven or furnace of the present invention over prior art ovens or furnaces is that the pneumatic cylinders or other means of moving the side walls and the door will automatically compensate for wear in the insulation. As the insulation on the side walls and on the edges of the floor becomes worn, the side walls will be moved slightly further to maintain a sealed relationship with said floor. Similarly, the door will be closed slightly further to maintain a sealed relationship with the insulation on the side walls, floor and top.

What I claim as my invention is:

1. An oven for curing, heat treating, stress relieving or otherwise treating or processing objects, said oven being mounted on a supporting surface and comprising two side walls, two end walls, a floor and a top, each being insulated, one of said end walls being a door that can be opened and closed, with means for affixing said side walls to said top, said side walls being movable laterally relative to said floor, with actuators to rapidly move a lower portion of said side walls laterally into and out of a sealing relationship with said floor, said floor having support means so that the floor is readily removable from and replaceable in said oven, said actuators remaining stationary as said floor is removed with said side walls being totally disengaged from said floor, a lower portion of said side walls being movable so that, when said floor is placed in said oven, the lower portion of said side walls can be moved and held in tight contact with adjacent side edges of said floor and said door can be closed so that an interior of said oven is insulated from an exterior and, when said floor is desired to be removed from said oven, the door can be opened and the lower portion of said side walls can be moved out of contact with the adjacent side edges of said floor and said floor can then be removed from said oven, said oven having a heat source with means to circulate heat within said oven.

2. An oven as claimed in claim 1 wherein the walls, floor and top are each insulated by a layer of insulation on an interior surface thereof, the insulation on the floor being arranged so that when the side walls are held in tight contact with said floor, the insulation on said side walls is in a sealed relationship with the insulation on the adjacent side edges of said floor.

3. An oven as claimed in claim 2 wherein the support means for the floor are wheels, said wheels being beneath said layer of insulation on said floor.

4. An oven as claimed in any one of claims 1, 2 or 3 wherein the actuators are pneumatic cylinders mounted on said side walls exterior of said insulation.

5. An oven as claimed in claim 2 wherein the layer of insulation on each of the side walls is mounted on an interior surface of a hard shell that is sufficiently bendable that a lower portion of said side walls can be moved relative to said floor so that the layer of insulation on said side walls can be removed repeatedly from being out of contact with the insulation on said floor to a sealed relationship with the insulation on said floor.

6. An oven as claimed in claim 5 wherein the actuators are pneumatic cylinders mounted on said side walls outside of said insulation.

7. An oven as claimed in claim 2 wherein the side walls have an upper portion that is rigidly affixed to said top.

8. An oven as claimed in claim 7 wherein each side wall has a hard outer shell to which said insulation is affixed, said outer shell having a lower portion and an upper portion, said lower portion being pivotally mounted on said upper portion.

9. An oven as claimed in any one of claims 1, 2 or 3 wherein each side wall is hinged along a line of contact with said top to said top.

10. An oven as claimed in any one of claims 1, 2 or 3 wherein each side wall has a lower portion that is hinged to an upper portion.

11. An oven as claimed in claim 2 wherein the door is pivotally mounted about a point located away from said oven so that said door can swing into tight contact with said side walls, floor and top when the door is in a closed position and can swing out of contact with said side walls, floor and top when the door is in an open position.

12. An oven as claimed in claim 11 wherein the door is hinged and is opened and closed by pneumatic cylinders.

13. An oven as claimed in claim 3 wherein there are guide means for said wheels.

14. An oven as claimed in claim 13 wherein the guide means is a track upon which said wheels can rotate.

15. An oven as claimed in claim 13 wherein said guide means is a channel within which said wheels can rotate.

16. An oven as claimed in claim 3 wherein the side walls have a hard shell made of galvanized steel on which the insulation is mounted.

17. An oven as claimed in claim 16 wherein the galvanized steel has a thickness of 0.116 inches and the insulation is mounted using mounting spikes.

18. An oven as claimed in claim 3 wherein the floor has a frame made of galvanized steel.

19. An oven as claimed in any one of claims 1, 2 or 3 wherein the insulation is fibre wool.

20. An oven as claimed in claims 1, 3 or 5 wherein there is an insulated casing surrounding said oven, except in the area of said door, and separated from said oven by an air space.

21. An oven as claimed in claims 1, 3 or 5 wherein there is an insulated casing surrounding said oven, except in the area of said door, and separated from said oven by an air space, a top of said oven laterally extending beyond said side walls of said oven and being affixed to side walls of said casing.

22. An oven as claimed in any one of claims 1, 3 or 5 wherein the maximum temperature within the oven ranges from 1200° F. to 3000° F.

23. An oven as claimed in any one of claims 1, 2 or 3 wherein the side walls have hydraulic cylinders connected to a frame along a lower edge of said side walls, the other end of said cylinders being mounted on a base.

* * * * *